US005853322A

United States Patent [19]

Jones et al.

[11] Patent Number: 5,853,322

[45] Date of Patent: Dec. 29, 1998

[54] COIN DISPENSER CHECK WRITING SURFACE WITH OPTIONAL CONTROL PANEL

[75] Inventors: Michael F. Jones, Mt. Vernon, N.H.; Paul O. Stump, Topsfield, Mass.

[73] Assignee: Telequip Corporation, Hollis, N.H.

[21] Appl. No.: 745,030

[22] Filed: Nov. 7, 1996

[51] Int. Cl.[6] ..... G07D 1/00

[52] U.S. Cl. ..... 453/63; 186/59

[58] Field of Search ..... 186/52, 59, 61–69; 453/20, 21, 18, 63; 312/140.14

[56] References Cited

U.S. PATENT DOCUMENTS

| | | | |
|---|---|---|---|
| 2,564,719 | 8/1951 | Powell | 453/20 X |
| 4,138,000 | 2/1979 | Hartup | 186/59 X |
| 5,086,879 | 2/1992 | Latimer et al. | 186/61 |
| 5,390,764 | 2/1995 | Kerber | 186/68 |

OTHER PUBLICATIONS

Telequip Corporation, Product Depiction.

Telequip Corporation, Transact Coin Dispenser with Cointrak, Product Literature.

Brandt, Inc., Model #559, Accuchange Coin Dispenser, Product Literature, 1988.

Brandt, Inc., Model #580, Cashier Coin Dispenser, Product Literature.

Brandt, Inc., Model #583, Remote Keyboard Dispenser, Product Depiction.

*Primary Examiner*—F. J. Bartuska

*Attorney, Agent, or Firm*—Perman & Green, LLP

[57] ABSTRACT

A flat writing surface is attached to the chassis of a coin or token dispenser by a hinge or other manner of attachment in either a sloped or horizontal fashion. In a particular embodiment, the attached writing surface has a ledge at one edge to hold the item being written. A writing instrument may be optionally attached. Frequently accessed controls and serviceable components of the coin dispenser can be grouped together in an easily accessible control panel beneath the writing surface, preferentially in a recessed well, that is accessible by flipping up or lifting of the writing surface. Location beneath the writing surface keeps the controls from being accidentally or intentionally operated by an unauthorized person. The control panel is optionally locked shut, preventing the writing surface from being flipped or lifted up to expose the control panel by unauthorized individuals.

9 Claims, 2 Drawing Sheets

COIN DISPENSER CHECK WRITING SURFACE WITH OPTIONAL CONTROL PANEL

FIELD OF THE INVENTION

The present invention relates to electromechanical devices and, in particular, to coin dispensing mechanisms.

BACKGROUND

A coin or token dispensing machine typically consists of a body portion, or chassis, to which a separate coin/token canister or magazine is removably attached. The chassis has a ramp or chute down which the coins or tokens roll after ejection from the canister. To prevent the canister being removed by an unauthorized individual, a lock is often provided on the dispenser body that locks the canister in place within the chassis of the machine.

Coin dispensing machines can be very bulky, consuming a fair amount of counter space. In addition, in many situations where coin or token dispensing machines are used counter space is either very limited or needed for other purposes. For example, at a teller's window, room must be provided for such activities as check writing, check validation, cash counting and distribution, cashier's check generation, traveler's check processing, and coin counting and dispensing. At a point-of-sale, space must often be provided for many functions including check writing, cash receipt, counting, and dispensing, price read or key in, security device removal and disarming, price tag removal, purchase packaging, hanger or other display device removal and storage, and credit or debit card handling. Often counter space is also needed at a point-of-sale for even larger space-consuming functions, such as grocery scanning and packing.

Check writing is today usually performed at a separate stand that must be housed on or in its own counter space. What has been needed is a way to combine the coin dispensing and check writing functions in such a way that use of valuable counter space for these purposes is minimized. This has not been accomplished in prior art coin dispensers, possibly because the typical coin dispenser shape and configuration has not been suitable for the addition of a writing stand. For example, some prior art machines have the coin canister or magazine inserted in a slanted orientation, making space below and behind the dispenser inaccessible for other uses [See, e.g., the Telequip Corporation Transact coin dispenser]. Other prior art machines are configured in a format that has no suitable place for a check writing stand because of the location of the control panel [See, e.g., Brandt Model 580 CASHIER coin dispenser].

Coin/token dispensing machines also require a variety of controls, for example, an on/off switch, one or more communications interface connections, a power "on" indicator, and a system power fuse. In the past, coin dispensing machine controls have typically been either placed under screwed-on panels on the back, side, or bottom of the machine or left unprotected and out in the open for easy access. Access to controls via a screwed-on panel requires tools, time, and, frequently, disconnection of the machine, sometimes even including unbolting the machine from the counter.

Controls in such positions are therefore usually either difficult for the authorized user to access, or are too accessible in that unauthorized persons can either accidentally or intentionally access and operate them. This can be a serious problem, especially since coin dispensing machines must necessarily be located in very public areas in order to have much utility. What has been needed, therefore, is a coin dispenser control panel that is easily accessible to the authorized individual but is hidden from the notice of, and protected from access by, unauthorized persons.

OBJECTS OF THE INVENTION

Accordingly, a primary object of the present invention is to provide a writing surface specifically adapted for use with a coin dispenser.

In particular, an object of the present invention is to provide a check-writing surface that is an integral part of a coin dispensing machine.

A further particular object of this invention is to conserve counter space at a point of sale or teller's window by combining the check writing and coin dispensing apparatuses.

An additional particular object of this invention is to provide a coin dispensing machine with controls that are easily accessed by an authorized user but are also both hidden and protected from unauthorized individuals.

SUMMARY

In one aspect of the invention, a writing surface is attached to the chassis of a coin or token dispenser. The writing surface is preferentially a flat surface and is attached to the chassis by a hinge or any other manner of attachment known in the art. The attached writing surface can be either sloped or horizontal and is sized to accommodate the anticipated use or space requirement. In a particular aspect of the invention, the attached writing surface has a ledge at one edge to hold the item being written. A writing instrument such as a pen may be optionally attached.

In another aspect of the invention, frequently accessed controls and serviceable components of the coin dispenser are grouped together in an easily accessible control panel beneath the writing surface, preferentially in a well to allow space for the controls to be the most convenient shape and size. Any coin dispenser control to which easy, yet secure access is desired may be included, reducing the need for opening of the system and for service calls. Location beneath the writing surface keeps the controls from being accidentally or intentionally operated by an unauthorized person, particularly if the control panel is locked shut. The control panel is optionally locked shut, according to a further aspect of the invention, by engaging a locking mechanism with a key, securing the writing surface to the top of the control panel well. When the control panel has been locked, the writing surface can not be flipped or lifted up to expose the control panel until the locking mechanism is again released by use of the key. The locking mechanism is any of a large number of such mechanisms well-known in the art. Locking of the control panel may instead be accomplished utilizing a lock that also secures the coin canister in the coin dispensing machine.

DETAILED DESCRIPTION OF THE PREFERRED EMBODIMENT

Figure 1:
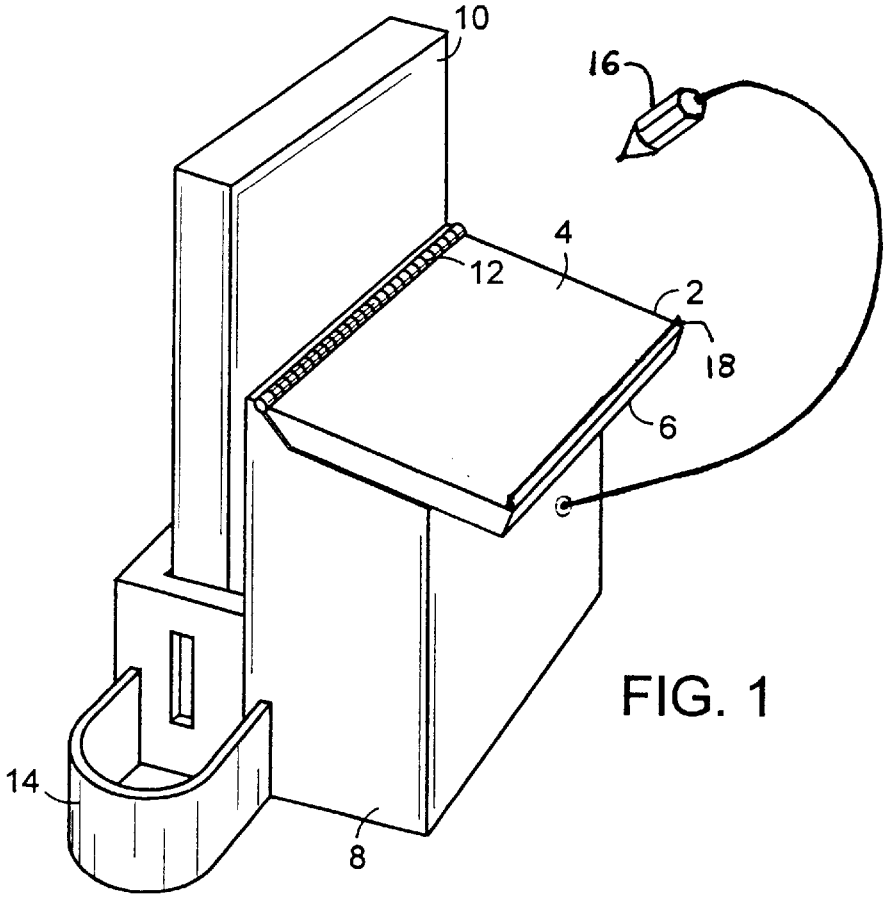
FIG. 1 is an embodiment of the coin dispenser writing surface of the present invention.

As seen in FIG. 1, a writing surface 2 having a top surface 4 and a bottom surface 6 is attached to the chassis 8 of a coin or token dispenser. The writing surface 2 is preferentially a flat surface attached at either the front or back of the coin dispenser canister or magazine 10. In the embodiment depicted in FIG. 1, the writing surface 2 is attached to the chassis 8 by a hinge 12, but any manner of attachment known in the art would be suitable. The writing surface 2 is located so that it does not interfere with the use of the coin cup 14 into which coins are dispensed from the coin canister 10.

While the depicted embodiment of the writing surface 2 is sloped, obviously a horizontal surface would be equally effective for the intended purpose. In the preferred embodiment, the writing surface 2 is sufficiently large to accommodate all the commonly used sizes of checks, but the writing surface 2 may be either smaller or larger to accommodate any anticipated use or space requirement. The writing surface 2 may optionally have a ledge or ridge 18 on the edge of the top surface 4 that is farthest from the coin canister 10 to hold the check, paper, etc. that is to be written upon. Also optional is the inclusion of a writing instrument 16, such as a pen, which can be attached to the writing surface 2 or coin dispenser chassis 8 by a chain or any of a number of other methods well-known in the art.

Figure 2:
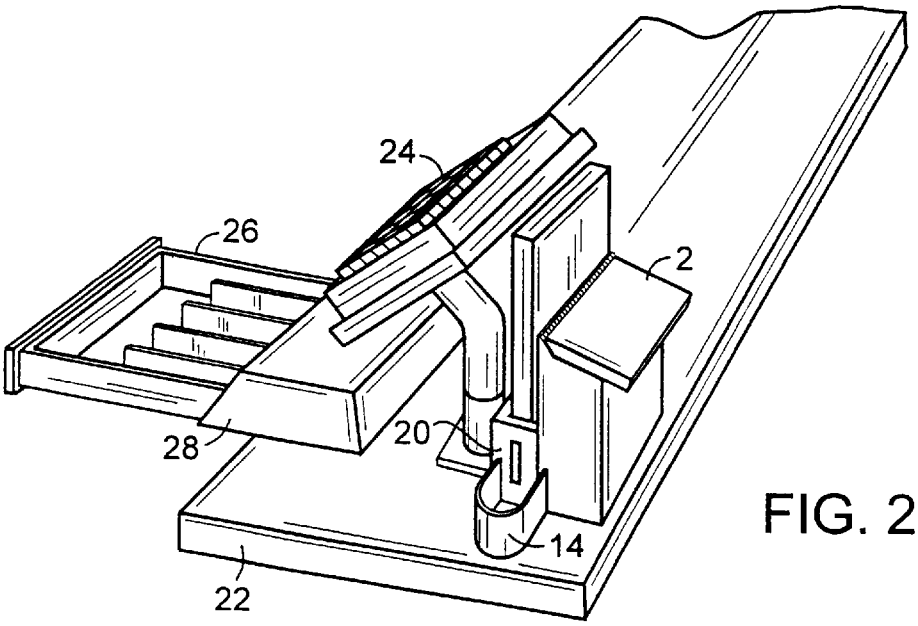
FIG. 2 is an embodiment of the coin dispenser writing surface of the present invention that is installed in a store checkout counter.

In FIG. 2, a coin dispenser 20 with an attached writing surface 2 is installed in a store checkout counter 22. The coin dispenser 20 is located behind and beneath the data entry keyboard 24 so that the writing surface 2 and coin cup 14 are accessible to the customer, while the cash drawer 26 and cash register body 28 are accessible to the sales person. As can be seen from FIG. 2, this configuration allows multiple uses to be made of the same limited counter area. The attached writing surface 2 on the coin dispenser 20 therefore allows more efficient use to be made of limited available counter space than in the current system of providing a check writing stand at a separate counter location removed from the coin dispenser.

Figure 3:
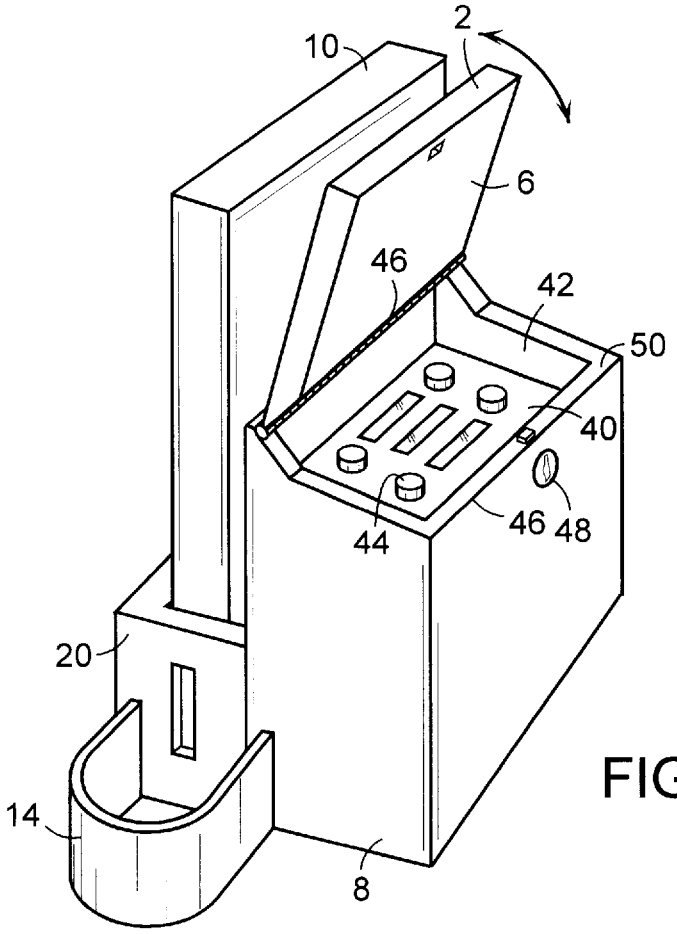
FIG. 3 is an embodiment of the coin dispenser writing surface of the present invention having the writing surface raised to reveal an embodiment of the optional control panel of the present invention.

As shown in FIG. 3, frequently accessed controls and serviceable components may optionally be grouped together in an easily accessible control panel 40 beneath the writing surface 2. The control panel 40 is preferentially in a recessed area, the control panel well 42, which allows space for the controls to take the most efficient and logical shape and size for their intended function.

Controls 44 in the control panel 40 preferentially include, but are not limited to, the coin dispensing machine on/off switch, one or more communications interface connections, a power "on" indicator, and the system power fuse. Any coin dispenser control to which easy, yet secure, access is desired may be included in the control panel 40. Such access reduces the need for opening of the system and for service calls. Location beneath the writing surface 2 keeps the controls 44 from being accidentally operated by an unauthorized person and conceals them from the notice of any persons intent on casual or malicious interference with the machine.

In FIG. 2, the writing surface 2 is attached to the top edge 50 of the control panel well 42 by a hinge 46, allowing the writing surface 2 to be flipped up for access to the control panel 40 without removal of the writing surface 2 from the coin dispenser chassis 8. In an alternate embodiment, the bottom surface 6 of the writing surface 2 is constructed, in any number of manners well-known in the art, so as to allow the writing surface 2 to act as a removable lid on the control panel well 42 that is lifted off for access to the controls 44.

The control panel 40 is optionally locked shut to prevent unauthorized access. In FIG. 3, locking is accomplished by engaging a locking mechanism 48 with a key, thus securing the writing surface 2 to the top edge 50 of the control panel well 42 at the bottom surface 6 of the writing surface 2. When the control panel 40 has been locked, the writing surface 2 can not be flipped or lifted up to expose the control panel 40 until the locking mechanism 48 is again released by use of the key. The locking mechanism 48 can be any of a large number of such mechanisms that are well-known in the art and therefore needs no further description here. If desired, locking of the control panel 40 may instead be accomplished by utilizing the same lock that secures the coin canister 10 in the coin dispensing machine, also through mechanisms well-known in the art.

Modifications and substitutions by one of ordinary skill in the art are considered to be within the scope of the present invention, which is not to be limited except by the claims which follow.

What is claimed is:

1. A coin dispenser writing surface comprising, in combination:

a coin dispensing means;

a flat surface integrally attached to said coin dispensing means, said flat surface being accessible to a user of said coin dispensing means in a manner that allows use of said flat surface for writing, said flat surface further being positioned so as not to interfere with other functions of said coin dispensing means;

at least one control or serviceable component for said coin dispensing means; and a control panel means for holding said at least one control of said coin dispensing means, said control panel means being located beneath said flat surface.

2. The coin dispenser writing surface of claim 1, wherein said control panel is located in a recessed well beneath said writing surface.

3. The coin dispenser writing surface of claim 2, wherein said writing surface is attached to said coin dispensing mechanism by a hinge that allows said writing surface to be flipped up for access to said control panel.

4. The coin dispenser writing surface of claim 2, wherein said writing surface is adapted to fit in a lid-like manner onto said recessed well so as to allow said writing surface to be lifted off for access to said control panel.

5. The coin dispenser writing surface of claim 3, further including a locking mechanism to prevent said control panel from being accessed by unauthorized individuals.

6. The coin dispenser writing surface of claim 4, further including a locking mechanism to prevent said control panel from being accessed by unauthorized individuals.

7. A coin dispensing machine with check writing stand and control panel access, comprising, in combination:

a coin dispensing machine having at least one control, connection, or serviceable component;

a check writing surface integrally attached to said coin dispensing machine, said check writing surface being accessible to a user of said coin dispensing machine for writing; and a control panel means for holding said at least one control, connection, or serviceable component of said coin dispensing machine, said control panel means being located beneath said check writing surface in a recessed area.

8. The coin dispensing machine with check writing surface and control panel access of claim 7, wherein said check writing surface is attached to said coin dispensing machine by a hinge means and is flipped up for access to said control panel.

9. The coin dispensing machine with check writing surface and control panel access of claim 7, wherein said check writing surface is adapted to fit onto said recessed area like a cover that allows said check writing surface to be lifted off for access to said control panel.

* * * * *